US007148856B2

(12) United States Patent
Parsche et al.

(10) Patent No.: US 7,148,856 B2
(45) Date of Patent: Dec. 12, 2006

(54) ELECTRONIC DEVICE INCLUDING TETRAHEDRAL ANTENNA AND ASSOCIATED METHODS

(75) Inventors: Francis Eugene Parsche, Palm Bay, FL (US); Dennis Lee Tebbe, Melbourne, FL (US)

(73) Assignee: Harris Corporation, Melbourne, FL (US)

( * ) Notice: Subject to any disclaimer, the term of this patent is extended or adjusted under 35 U.S.C. 154(b) by 0 days.

(21) Appl. No.: 11/112,620

(22) Filed: Apr. 22, 2005

(65) Prior Publication Data

US 2006/0238434 A1 Oct. 26, 2006

(51) Int. Cl.
*H01Q 9/16* (2006.01)

(52) U.S. Cl. ..... 343/793; 343/795; 343/810

(58) Field of Classification Search ..... 343/795, 343/793, 810

See application file for complete search history.

(56) References Cited

U.S. PATENT DOCUMENTS 3,980,952 A 9/1976 Rapshys ..... 325/16
6,281,858 B1 * 8/2001 Jennetti et al. ..... 343/818
6,700,489 B1 * 3/2004 Easter et al. ..... 340/572.3
6,822,621 B1 * 11/2004 Lamour et al. ..... 343/896
6,972,699 B1 * 12/2005 Olodort et al. ..... 341/22
7,034,749 B1 * 4/2006 Leeper et al. ..... 343/700 MS

FOREIGN PATENT DOCUMENTS

JP 11-353427 * 12/1999

* cited by examiner

*Primary Examiner*—Trinh Vo Dinh
(74) *Attorney, Agent, or Firm*—Allen, Dyer, Doppelt, Milbrath & Gilchrist, P.A.

(57) ABSTRACT

An electronic device includes a housing having a plurality of panels connected together to define a closed geometric shape having one or more corners. An electrically conductive layer is carried by the housing to define a first dipole element, and a second dipole element is carried by housing adjacent one corner thereof. Circuitry comprising at least one active electronic component, such as sensor and/or a battery, is mounted within the housing, and an antenna feed is connected between the circuitry and the first and second dipole elements.

28 Claims, 4 Drawing Sheets

ELECTRONIC DEVICE INCLUDING TETRAHEDRAL ANTENNA AND ASSOCIATED METHODS

FIELD OF THE INVENTION

The present invention relates to the field of antennas, and more particularly, this invention relates to small low-cost broadband antennas and related methods.

BACKGROUND OF THE INVENTION

Newer designs and manufacturing techniques have driven electronic components to small dimensions and miniaturized many communication devices and systems. Unfortunately, antennas have not been reduced in size at a comparative level and often are one of the larger components used in a smaller communications device. For example, the FCC now allows Ultra Wide-Band (UWB) communication devices to operate at low power in an unlicensed spectrum from 3.1 to 10.6 GHz. One application of this spectrum is the networking of Unattended Ground Sensors (UGS) that utilize UWB communication devices. For such applications there is a need for antennas with broad bandwidth, relatively small volume, and reasonable manufacturing cost.

In current practice, communications devices are used with many different types of dipoles, biconical dipoles, conical monopoles and discone antennas. These antennas, however, are sometimes large and include impractical shapes for a specific application.

Conical antennas, which include a single inverted cone over a ground plane, and biconical antennas, which include a pair of cones oriented with their apexes pointing toward each other, are used as broadband antennas for various applications, for example, direction finding. A biconical antenna includes a top inverted cone and a bottom cone. An electronic coupler provides a connection to a feed circuit that provides the electrical signal that feeds the antenna. The antenna is symmetric about the cone axis and each of the cones is a full cone (spanning 360°). Similarly, a single cone antenna includes a single antenna cone (also spanning 360°) which is symmetric about the cone axis. A single antenna cone is connected to an electronic coupler that provides a connection to a feed circuit that provides the electrical signal to the antenna. The single cone antenna is located over a ground plane.

For example, U.S. Pat. No. 6,198,454 to Sharp et al. is directed to a broadband partial fan cone antenna. The antenna includes a radiator having a partial cone shape.

However, none of these approaches focuses on providing a small low-cost broadband antenna.

SUMMARY OF THE INVENTION

In view of the foregoing background, it is therefore an object of the present invention to provide a low-cost broadband antenna and associated electronic device and methods.

This and other objects, features, and advantages in accordance with the present invention are provided by an electronic device including a housing having a plurality of panels connected together to define a closed geometric shape having one or more corners. An electrically conductive layer is carried by the housing to define a first dipole antenna element, and a second dipole antenna element is carried by the housing adjacent one corner thereof. Circuitry comprising at least one active electronic component, such as a radio, is mounted within the housing on one or more of the panels, and an antenna feed is connected between the circuitry and the first and second dipole antenna elements.

A non-electrically-conductive portion of the housing is preferably between the electrically conductive layer and the at least one corner. Each of the plurality of panels may comprise a flat polygon-shaped panel and the geometric shape of the housing may comprise a polyhedron-shaped enclosure. Each of the plurality of panels may comprise a printed circuit board on the side internal to the enclosure and comprise a surface for the electrically conductive metallization layer on the (other) side external to the enclosure. The second dipole element may be comprised of a plurality of wires, such as six wires, for example, positioned as radials of a virtual disc. In this example, three wires positioned as chords of the virtual disc can be utilized instead of the six radial wires.

Another aspect of the invention is directed to a dipole antenna including a housing comprising a plurality of flat panels connected together to define a closed tetrahedral shape having four corners, and an electrically conductive layer carried by the housing to define a first dipole element. A non-electrically conductive portion of the housing is between the electrically conductive layer and one corner, and a second dipole element is carried by the housing adjacent to the one corner thereof.

The plurality of flat panels may comprise a printed circuit board, and the electrically conductive layer may comprise a metallization layer on the outside of the printed circuit board. The second dipole element preferably comprises a plurality of wires, such as six wires positioned as radials of a disc.

A method aspect of the invention is directed to a method of making an electronic device including providing a plurality of panels connected together to form a housing defining a closed geometric shape having at least one corner. An electrically conductive layer carried by the housing is provided to define a first dipole element, and a second dipole element carried by housing is provided adjacent the at least one corner thereof. Circuitry comprising at least one active electronic component, such as a radio and one or more sensors and a battery, is mounted within the housing, and an antenna feed is connected between the circuitry and the first and second dipole elements.

A non-electrically conductive portion of the housing is provided between the electrically conductive layer and the at least one corner. Also, each of the plurality of panels may comprise a flat polygon-shaped panel, and the geometric shape may comprise a tetrahedral shape. The plurality of panels may comprise a printed circuit board, and the electrically conductive layer may comprise a metallization layer on the outside of the printed circuit board. The second dipole element may be formed of a plurality of wires, such as three wires positioned as chords of a disc.

Another method aspect of the invention is directed to a method of making a dipole antenna including providing a plurality of flat panels to form a housing defining a closed tetrahedral shape having four corners, and providing an electrically conductive layer carried by the housing to define a first dipole element. A non-electrically conductive portion of the housing is provided between the electrically conductive layer and one corner, and a second dipole element carried by the housing is provided adjacent the one corner thereof.

Again, the plurality of flat panels may comprise a printed circuit board, and the electrically conductive layer may comprise a metallization layer on the outside of the printed circuit board. The second dipole element may comprise a plurality of wires, such as three wires positioned as chords of a disc.

DETAILED DESCRIPTION OF THE PREFERRED EMBODIMENTS

Figure 1:
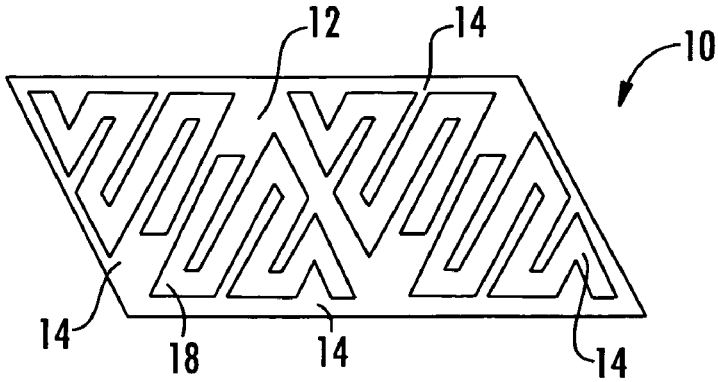
FIG. 1 is a schematic bottom view of the exterior of the panels of the electronic device and antenna of the present invention in a pre-assembled state.
Figure 2:
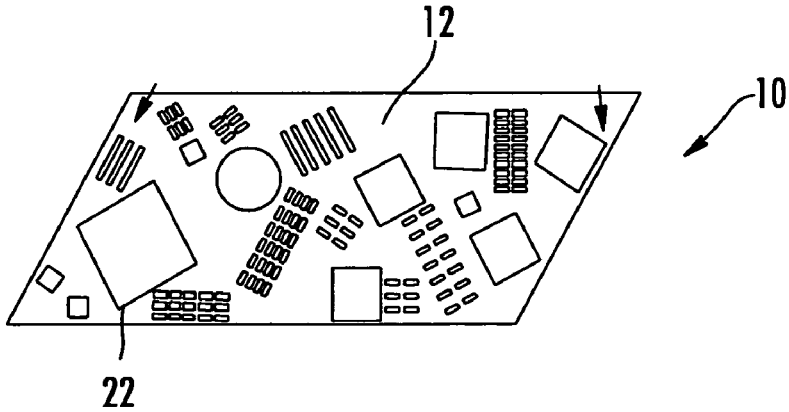
FIG. 2 is a schematic top view of the interior of the panels of FIG. 1.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Referring initially to FIGS. 1–4, a low cost broadband antenna and associated electronic device 10 and methods will now be described. The electronic device 10 includes a housing 12 having a plurality of panels 14 connected together to define a closed geometric shape having one or more corners 16. An electrically conductive layer 18 is carried by the housing 12 to define a first dipole element 19. Preferably, the entire external surface of the panels 14 is metallized to define the electrically conductive layer 18. A second dipole element 20 is carried by housing adjacent one corner thereof. The second dipole element 20 may comprise a plurality of wires 28, such as three wires positioned as chords of a virtual disc or 6 wires positioned as radials of the disc.

Circuitry 22 including at least one active electronic component, such as radio, sensor and/or a battery, is mounted within the housing 12, and an antenna feed 24 is connected between the circuitry 22 and the first 19 and second 20 dipole elements. The circuitry may be associated with an ultra-wide band (UWB) communication, ranging and sensing device and/or a wireless local area network (WLAN) hub. The electronic device 10 may be used in various applications including commercial and military applications, such as Radio Frequency Identification Devices (RFID), scatterable unattended ground sensors (SUGS), WLAN hubs and/or anti-theft devices, for example.

A non-electrically conductive portion 26 of the housing 12 is preferably between the electrically conductive layer 18 and the at least one corner 16. Each of the plurality of panels 14 may comprise a flat polygon shaped panel and the geometric shape of the housing 12 may be a tetrahedral shape.

Figure 3:
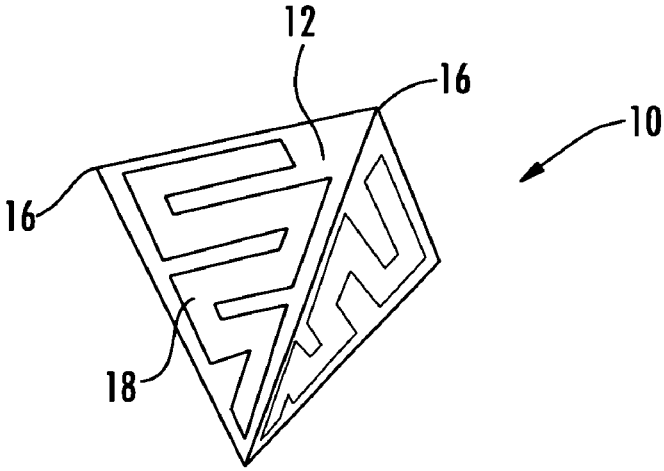
FIG. 3 is a schematic plan view of the exterior of the electronic device and antenna of the present invention in an assembled state.
Figure 4:
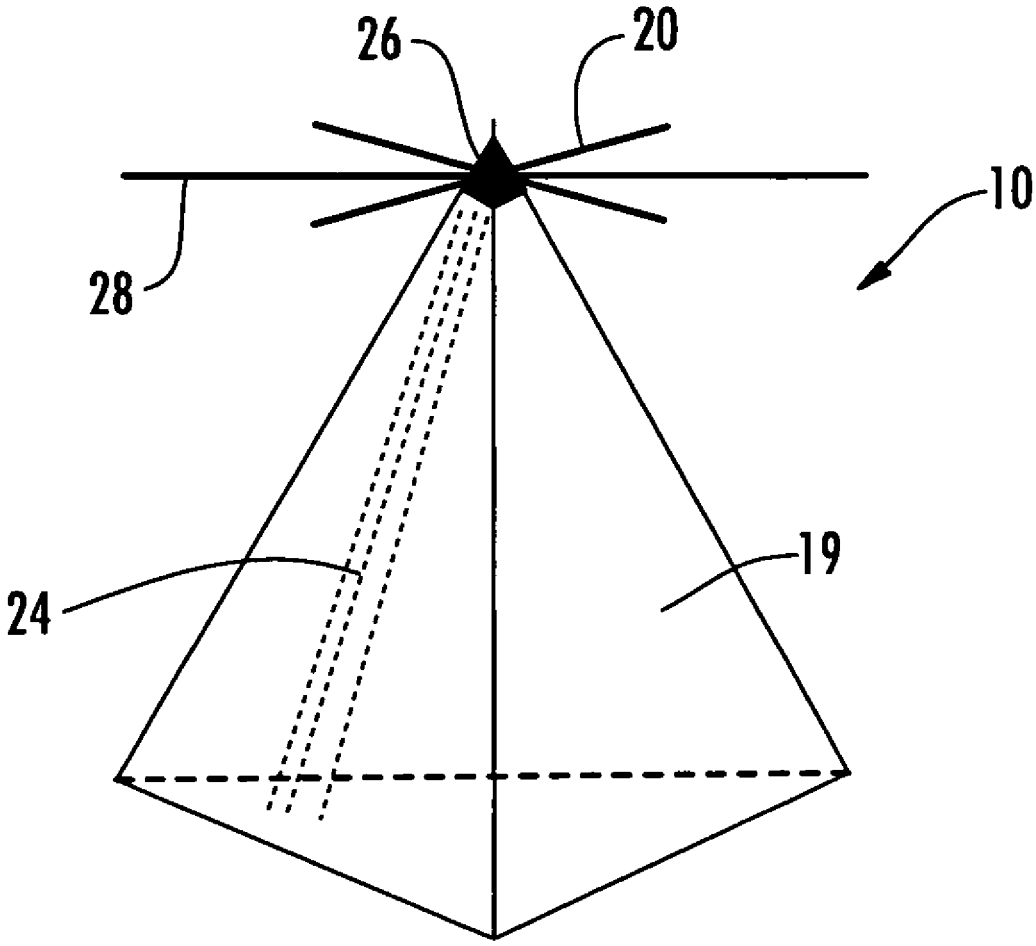
FIG. 4 is a schematic side view of the electronic device and antenna of the present invention.

The plurality of panels 12 preferably comprise a printed circuit board and the electrically conductive layer 18 may comprise a metallization layer on the outside of the printed circuit board. The printed circuit board preferably includes fold-lines, defining the panels 14, so that the board may be folded there-along to create the closed geometric shape as illustrated in FIGS. 3 and 4. Other shapes are contemplated as long as they include a corner 16 on which to mount the second dipole element 20. The shape of the panels 14 should provide a planar fold-up method of manufacturing. Moreover, a flat sheet of substrate material can be tiled with a plurality of the unfolded antenna housings 12 which would also allow for low-cost printed wiring board (PWB) fabrication techniques to be used. As discussed, after folding up the panels 14 of the antenna housing 12, the interior walls define PWBs for electronics associated with the antenna.

A method aspect of the invention is directed to a method of making an electronic device 10 including providing the plurality of panels 14 connected together to form the housing 12 defining a closed geometric shape having at least one corner 16. The electrically conductive layer 18 carried by the housing 12 is provided to define the first dipole element 19, and the second dipole element 20 carried by housing is provided adjacent the at least one corner 16 thereof. Circuitry 22 comprising at least one active electronic component, such as a sensor and a battery, is mounted within the housing, and an antenna feed 24 is connected between the circuitry and the first and second dipole elements 19, 20.

The non-electrically conductive portion 26 of the housing 12 is provided between the electrically conductive layer 18 and the at least one corner 16. Also, each of the plurality of panels 14 may comprise a flat polygon shaped panel, and the geometric shape may comprise a tetrahedral shape, as illustrated in the preferred embodiment. The plurality of panels 14 may comprise a printed circuit board, and the electrically conductive layer 18 may comprise a metallization layer on the outside of the printed circuit board. The second dipole element 20 may be formed of a plurality of wires 28, such as three wires positioned as chords of a disc.

The table below indicates the values of various antenna parameters in accordance with a tetrahedral antenna of one exemplary embodiment that was constructed and subjected to the measurement of physical and electromagnetic properties.

TABLE

| Parameter | Value | Method |
|---|---|---|
| Electrical Height | 0.31λ | Measurement |
| Lower Cutoff Frequency | 1440 MHz | Measurement |
| 3.0:1 VSWR Bandwidth | 42% | Measurement |
| Gain | 1.8 dBi | NEC4 Analysis |
| Pattern | $\cos^2\theta$ Elevation<br>Omni Azimuth | NEC4 Analysis |
| Polarization | Vertical Linear | NEC4 Analysis |
| Efficiency | 99%+ | NEC4 Analysis |
| Radiation Resistance | 110–140 Ohms | Measurement |
| Dispersion | Low due to Single Broad Resonance | Estimate |

Figure 5:
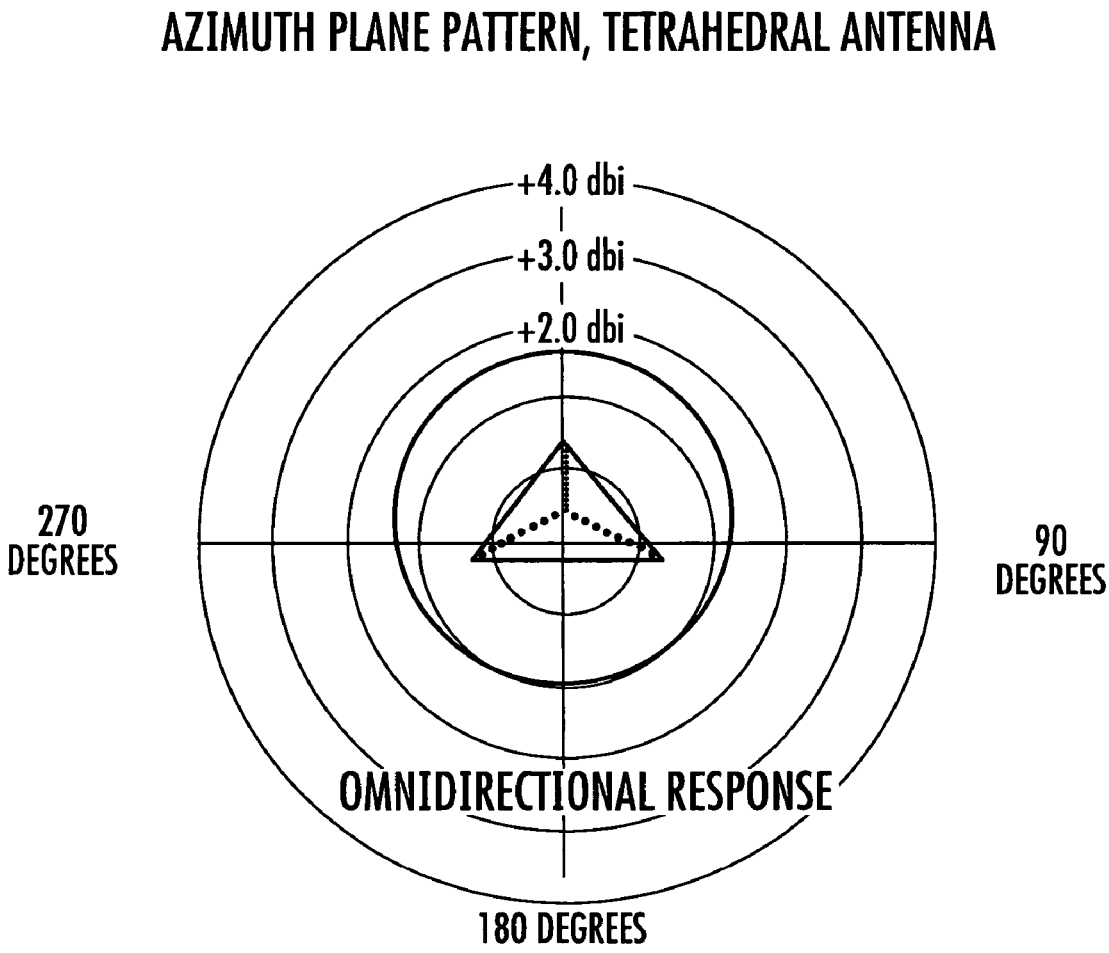
FIG. 5 is an azimuth plane pattern of the antenna of the present invention.
Figure 6:
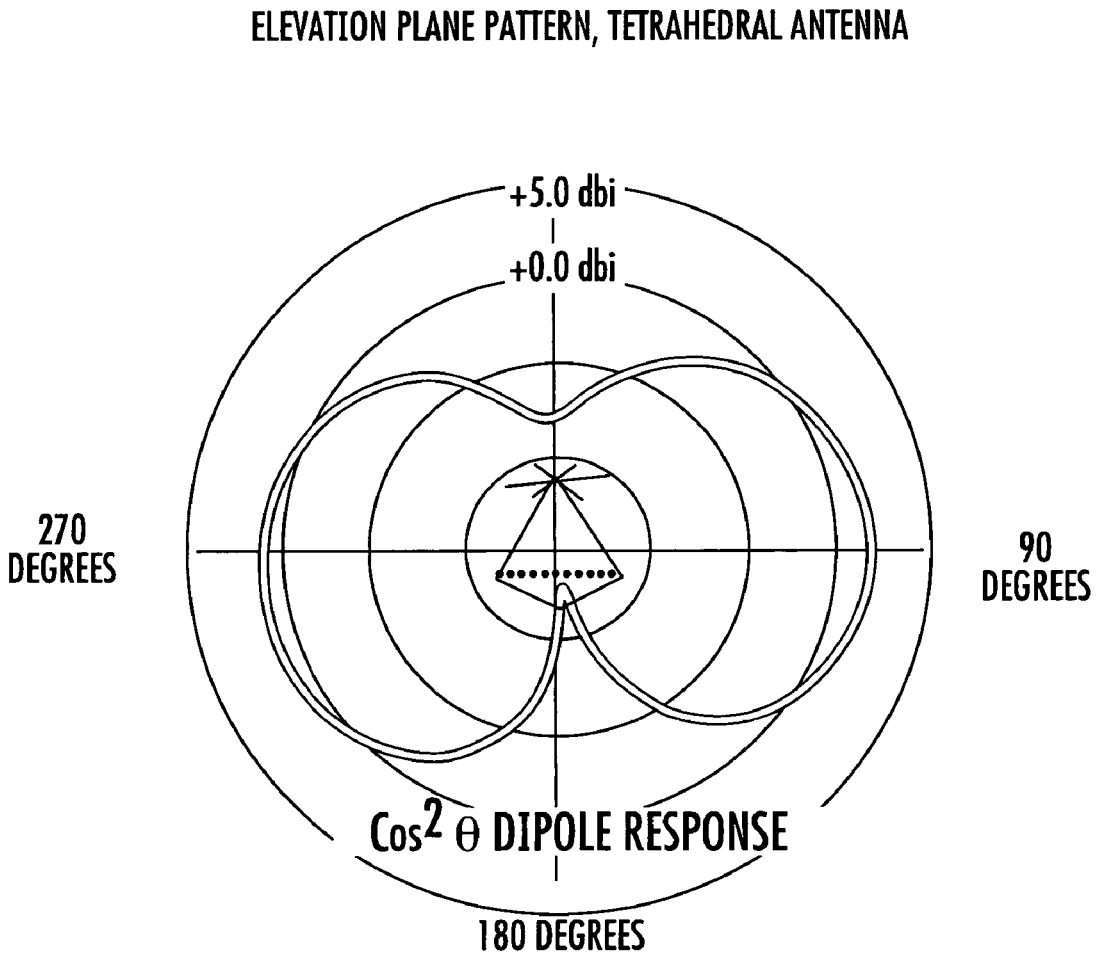
FIG. 6 is an elevation plane pattern of the antenna of the present invention.

Additionally, the azimuth plane pattern of the omnidirectional response of the tetrahedral antenna is illustrated in FIG. 5, while the elevation plane pattern of the $\cos^2\Theta$ dipole response of the tetrahedral antenna is illustrated in FIG. 6.

One modification that will be further described here is notable because it represents a category of modifications. Specifically, the three-dimensional geometry of the multi-panel dipole antenna element can be comprised of other shapes in addition to the tetrahedral shape. For the tetrahedral version described herein, the enclosure has four sides, each of which is an equilateral triangle. More generally, the number of sides can be five, six, seven, or even more. In every case, all but one of the sides (panels) will be triangular. The remaining side will be a square, pentagon, hexagon, heptagon, and so forth.

It can be noted that as the number of sides is increased the antenna element will more closely approximate a cone.

Accordingly, if it is desired that the antenna perform more like the discone antenna then the number of sides can be increased to accomplish that. This generalized antenna can be called a polyhedral antenna. The tetrahedral antenna is a special case of the polyhedral antenna. Additionally, the tetrahedral or polyhedral shapes can be used with or without the bottom panel as the antenna can operate as a closed container or open umbrella.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

The invention claimed is:

1. An electronic device comprising:

a housing comprising a plurality of panels connected together to define a closed geometric shape having at least one corner;

an electrically conductive layer on the plurality of panels to define a first dipole element;

a second dipole element carried by the housing adjacent the at least one corner thereof and externally to the closed geometric shape;

circuitry comprising at least one active electronic component mounted on an inside of the plurality of panels within the housing; and an antenna feed connected between the circuitry and the first and second dipole elements.

2. An electronic device according to claim 1 further comprising a non-electrically conductive portion of the housing between the electrically conductive layer and the at least one corner.

3. An electronic device according to claim 2, wherein each of the plurality of panels comprises a flat polygon shaped panels.

4. An electronic device according to claim 3 wherein the geometric shape comprises a tetrahedral shape.

5. An electronic device according to claim 1 wherein the plurality of panels comprise a printed circuit board.

6. An electronic device according to claim 5 wherein the electrically conductive layer comprises a metallization layer on the outside of the printed circuit board.

7. An electronic device according to claim 1 wherein the second dipole element comprises a plurality of wires.

8. An electronic device according to claim 7 wherein the plurality of wires comprise three wires positioned as cords of a disc.

9. An electronic device according to claim 1 wherein the at least one electronic component comprises at least one sensor and a battery.

10. A dipole antenna comprising:

a housing comprising a plurality of flat panels connected together to define a closed tetrahedral shape having four corners;

an electrically conductive layer on the plurality of flat panels to define a first dipole element;

a nonelectrically conductive portion of the housing between the electrically conductive layer and one corner; and a second dipole element carried by the housing adjacent the one corner thereof and externally to the closed tetrahedral shape.

11. A dipole antenna according to claim 10 wherein the plurality of flat panels comprise a printed circuit board.

12. A dipole antenna according to claim 11 wherein the electrically conductive layer comprises a metallization layer on the outside of the printed circuit board.

13. A dipole antenna according to claim 10 wherein the second dipole element comprises a plurality of wires.

14. A dipole antenna according to claim 13 wherein the plurality of wires comprises three wires positioned as chords of a disc.

15. A method of making an electronic device comprising:

providing a plurality of panels connected together to form a housing defining a closed geometric shape having at least one corner;

providing an electrically conductive layer on the plurality of panels to define a first dipole element;

providing a second dipole element carried by housing adjacent the at least one corner thereof and externally to the closed geometric shape;

mounting circuitry comprising at least one active electronic component on an inside of the plurality of panels within the housing; and connecting an antenna feed between the circuitry and the first and second dipole elements.

16. A method according to claim 15 further comprising providing a nonelectrically conductive portion of the housing between the electrically conductive layer and the at least one corner.

17. A method according to claim 15 wherein each of the plurality of panels comprises a flat ploygon shaped panels.

18. A method according to claim 17 wherein the geometric shape comprises a tetrahedral shape.

19. A method according to claim 15 wherein the plurality of panels comprise a printed circuit board.

20. A method according to claim 19 wherein the electrically conductive layer comprises a metallization layer on the outside of the printed circuit board.

21. A method according to claim 15 wherein the second dipole element comprises a plurality of wires.

22. A method according to claim 21 wherein the plurality of wires comprise three wires positioned as chords of a disc.

23. A method according to claim 15 wherein the at least one active electronic component comprises at least one sensor and a battery.

24. A method of making a dipole antenna comprising:

providing a plurality of flat panels to form a housing defining a closed tetrahedral shape having four corners;

providing an electrically conductive layer on the plurality of flat panels to define a first dipole element;

providing a nonelectrically conductive portion of the housing between the electrically conductive layer and one corner; and providing a second dipole element carried by the housing adjacent the one corner thereof and externally to the closed tetrahedral shape.

25. A method according to claim 24 wherein the plurality of flat panels comprise a printed circuit board.

26. A method according to claim 25 wherein the electrically conductive layer comprises a metallization layer on the outside of the printed circuit board.

27. A method according to claim 24 wherein the second dipole element comprises a plurality of wires.

28. A method according to claim 27 wherein the plurality of wires comprises three wires positioned as cords of a disc.

* * * * *

UNITED STATES PATENT AND TRADEMARK OFFICE

CERTIFICATE OF CORRECTION

PATENT NO. : 7,148,856 B2
APPLICATION NO. : 11/112620
DATED : December 12, 2006
INVENTOR(S) : Parsche et al.

It is certified that error appears in the above-identified patent and that said Letters Patent is hereby corrected as shown below:

| | |
|---|---|
| Column 5, Line 38 | Delete: "panels."<br>Insert: -- panel. -- |
| Column 6, Line 29 | Delete: " ploygon shaped panels "<br>Insert: -- polygon shaped panel -- |

Signed and Sealed this

Twelfth Day of June, 2007

JON W. DUDAS
*Director of the United States Patent and Trademark Office*